US005499082A

United States Patent [19]

Watanabe et al.

[11] Patent Number: 5,499,082

[45] Date of Patent: Mar. 12, 1996

[54] DEVELOPING DEVICE USING TWO-COMPONENT TYPE DEVELOPER HAVING DOCTOR BLADE RESILIENTLY ABUTTED AGAINST OPENINGS IN VESSEL AND AN OUTLET PORTION IN VESSEL TO DISCHARGE THE DEVELOPER

[75] Inventors: Mamoru Watanabe, Kawasaki; Michihiro Fujii, Hyogo; Nobuo Fujita, Kawasaki, all of Japan

[73] Assignee: Fujitsu Limited, Kawasaki, Japan

[21] Appl. No.: 994,281

[22] Filed: Dec. 21, 1992

[30] Foreign Application Priority Data

| | | | |
|---|---|---|---|
| Dec. 20, 1991 | [JP] | Japan | 3-105143 U |
| Jan. 30, 1992 | [JP] | Japan | 4-014691 |
| Apr. 7, 1992 | [JP] | Japan | 4-085165 |

[51] Int. Cl.[6] ..... G03G 15/06

[52] U.S. Cl. ..... 355/245; 355/251; 355/260

[58] Field of Search ..... 355/245, 246, 355/298, 260, 251, 252, 253, 259; 222/DIG. 1; 118/656, 657, 658, 653

[56] References Cited

U.S. PATENT DOCUMENTS

| | | | |
|---|---|---|---|
| 3,764,208 | 10/1973 | Takahashi et al. | 355/253 |
| 4,585,328 | 4/1986 | Moser et al. | 355/253 X |
| 4,625,895 | 12/1986 | Tsukano | 355/260 X |
| 4,845,523 | 7/1989 | Miyaji | 355/260 X |
| 4,848,267 | 7/1989 | Slayton et al. | 355/260 X |
| 5,045,339 | 3/1992 | Terashima | 355/246 X |
| 5,095,338 | 3/1992 | Hayes, Jr. et al. | 355/246 |
| 5,132,734 | 7/1992 | Momiyama et al. | 355/260 X |
| 5,233,390 | 8/1993 | Fujimoto | 355/245 |
| 5,303,010 | 4/1994 | Takano et al. | 355/245 |

FOREIGN PATENT DOCUMENTS

| | | |
|---|---|---|
| 0295187A2 | 12/1988 | European Pat. Off. . |
| 0365056A2 | 4/1990 | European Pat. Off. . |
| 3225006C2 | 8/1991 | Germany . |
| 63-177169 | 7/1988 | Japan . |

*Primary Examiner*—A. T. Grimley
*Assistant Examiner*—Shuk Y. Lee
*Attorney, Agent, or Firm*—Staas & Halsey

[57] ABSTRACT

A developing device using a two-component developer including a vessel for holding the two-component developer, a magnetic roller provided within the vessel and rotatably supported by side walls of the vessel to entrain and bring the developer to a developing zone for a development of an electrostatic latent image, and a doctor blade provided within the vessel to uniformly regulate an amount of the developer entrained by the roller. The ends of the doctor blade are movably inserted into openings formed in the side walls of the vessel, respectively, and the blade is provided with a spring associated therewith such that each of the ends of the blade is resiliently abutted against an end edge which partially defines the opening formed in the corresponding side wall of the vessel, whereby the blade is positioned with respect to the roller to a given clearance therebetween for a uniform regulation of the amount of the developer entrained by the roller. The developing device also includes at least two screw members arranged parallel with each other to define passages for circulating the two-component developer and a partition member, having two end portions, provided between the two screw members, the partition member having a length shorter than that of the screw members, so that developer circulating passages are in communication with each other at the two end portions of the partition member. The developing device have an outlet port formed in the bottom of the device.

20 Claims, 16 Drawing Sheets

DEVELOPING DEVICE USING TWO-COMPONENT TYPE DEVELOPER HAVING DOCTOR BLADE RESILIENTLY ABUTTED AGAINST OPENINGS IN VESSEL AND AN OUTLET PORTION IN VESSEL TO DISCHARGE THE DEVELOPER

BACKGROUND OF THE INVENTION

1. Field of the Invention

The present invention relates to a developing device used in an image formation apparatus such as a copying machine, a laser printer, a facsimile or the like, wherein an electrostatic latent image is electrostatically developed with a two-component type developer.

2. Description of the Related Art

Generally, in an image formation apparatus such as an electrophotographic recording apparatus, the following processes are typically carried out:

a) a uniform distribution of electrical charges is produced on a surface of an electrostatic latent image carrying body;

b) an electrostatic latent image is formed on a charged area of the body surface by an optical writing means such as a laser beam scanner, an LED (light emitting diode) array, a liquid crystal shutter array or the like;

c) the latent image is developed as a visible image with a developer or toner, which is electrically charged to be electrostatically adhered to the latent image zone;

d) the developed and charged toner image is electrostatically transferred from the body to a recording medium such as a cut sheet paper; and e) the transferred toner image is fixed and recorded on the cut sheet paper by a toner image fixing means such as a heat roller.

Typically, the electrostatic latent image carrying body may be an electrophotographic photoreceptor, usually formed as a drum, called a photosensitive drum, having a cylindrical conductive substrate formed of a metal such as aluminum, and a photoconductive insulating film bonded to a cylindrical surface thereof and formed of an organic photoconductor (OPC), a selenium photoconductor or the like.

As one type of developer, a two-component type developer is well known, which is composed of a toner component (colored fine synthetic resin particles) and a magnetic component (fine magnetic carriers). Usually, a developing device using this type of developer includes a vessel for holding the two-component developer, wherein the developer is agitated by an agitator provided therein. This agitation causes the toner particles and the magnetic carriers to be subjected to triboelectrification, whereby the toner particles are electrostatically adhered to each of the magnetic carriers. The developing device also includes a magnetic roller provided in the vessel as a developing roller in such a manner that a portion of the magnetic roller is exposed therefrom and faces the surface of the photosensitive drum. The magnetic carriers with the toner particles are magnetically adhered to the surface of the magnetic roller to form a magnetic brush therearound, and, by rotating the magnetic roller carrying the magnetic brush, the toner particles are brought to a nip zone or developing zone between the magnetic roller and the drum for development of an electrostatic latent image formed thereon. Namely, the two-component developer is magnetically entrained and brought by the magnetic roller to the developing zone. In the developing process, a developing bias voltage is applied to the magnetic roller so that the toner particles carried to the developing zone are electrostatically attracted only to the latent image, whereby the toner development of the latent image is carried out.

To ensure an even development of a latent image, it is necessary to uniformly regulate an amount of the developer brought to the developing zone by the magnetic roller. To this end, the developing device is provided with a doctor blade disposed in and attached to the vessel to be spaced from the magnetic roller to define a given clearance therebetween, whereby a uniform regulation of the amount of the developer brought by the magnetic roller can be carried out. In assembling the developing device, the doctor blade must be carefully and precisely positioned with respect to the magnetic roller to thereby obtain the given clearance therebetween before a desirable density of development can be ensured. Accordingly, the attachment of the doctor blade to the vessel involves a fine positional adjustment with respect to the magnetic roller, and this fine positional adjustment is troublesome so that the assembly of the developing device is costly.

The developer, from which the toner component is consumed for the development of a latent image, is removed from the magnetic roller by a scraper blade engaged therewith, and is then recovered back to the vessel, whereby a fresh part of the developer held in the vessel can be fed to and entrained by the magnetic roller to thereby maintain a constant density of development during the developing process. Nevertheless, in practice, the constant density of development cannot be maintained during the developing process because the toner component is not uniformly distributed in the developer held in the vessel, due to the recovery of the developer from the magnetic roller to the vessel. Note, this developer has a smaller toner component than the developer held in the vessel because of the consumption of the toner component for the development of the latent image. Of course, the non-uniform distribution of the toner component in the developer causes an uneven development of a latent image.

A developer circulation type device is well known as one type of developing device using the two-component developer, and is provided with an agitator including at least two screw members provided in the vessel and disposed in parallel with each other, and a partition member disposed between the screw members. The screw members are arranged and rotated in such a manner that a part of the developer held in the vessel is circulated between the screw members for the purpose of a uniform distribution of the toner component in the developer. Although the uniform distribution of the toner component in the developer can be obtained, a stable developing process cannot be ensued over a long period because a ratio of the toner component to the developer must be fall within a given range before a proper development can be continuously maintained. Namely, the ratio of the toner component to the developer becomes smaller as a content of the toner component in the developer becomes smaller through the consumption thereof for the development of latent images.

To this end, the developing device may also be provided with a developer supplier so that a toner component can be supplemented to the developer held in the vessel, if necessary, whereby the ratio of the toner component to the developer can be fall within the given range so that an operational life of the developing device can be prolonged.

On the other hand, the developer held in the vessel should be periodically exchanged for new developer so that a proper development of a latent image can be continuously maintained, because the magnetic component of the developer is gradually deteriorated to cause an improper development of a latent image. In this case, as much of the old developer as possible should be discharged from the vessel, because the larger the remaining part of the old developer, the sooner the deterioration of the new developer occurs. Also, of course, the exchange of the old developer for the new developer should be carried out as soon as possible. Nevertheless, the conventional developing device fails to rapidly discharge a substantially major part of the old developer from the vessel.

SUMMARY OF THE INVENTION

Therefore, an object of the present invention is to provide a developing device using a two-component type developer, wherein an attachment of a doctor blade to a vessel can be easily carried out without a fine positional adjustment of the doctor blade with respect to a magnetic roller for the purpose of obtaining a given clearance therebetween.

Another object of the present invention is to provide a developer-circulation type developing device using a two-component type developer, wherein a substantially major part of an old developer can be rapidly discharged from a vessel to exchange the same for new developer.

In accordance with a first aspect of the present invention, there is provided a developing device using a two-component developer, which comprises: a vessel means for holding the two-component developer; a magnetic roller means provided within the vessel means and rotatably supported by side walls of the vessel means to entrain and bring the developer to a developing zone for a development of an electrostatic latent image; and a doctor blade means provided within the vessel means to uniformly regulate an amount of the developer entrained by the magnetic roller means, wherein ends of the doctor blade means are movably inserted into openings formed in the side walls of the vessel means, respectively, and the doctor blade means is provided with a resilient means associated therewith such that each of the ends of the doctor blade means is resiliently abutted against an end edge which partially defines the opening formed in the corresponding side wall of the vessel means, whereby the doctor blade means is positioned with respect to the magnetic roller means to a given clearance therebetween for a uniform regulation of the amount of the developer entrained by the magnetic roller means.

In accordance with a second aspect of the present invention, there is provided a developing device using a two-component developer composed of a toner component and a magnetic component, which comprises: a vessel means for holding the two-component developer; a magnetic roller means rotatably provided within the vessel means to entrain and bring the developer to a developing zone for a development of an electrostatic latent image; and an agitator means provided in the vessel means for agitating and circulating the developer to cause a triboelectrification between the toner component and the magnetic component and a uniform distribution of the toner component in the magnetic component, wherein the agitator means includes at least two screw members arranged in parallel with each other to define a developer circulating passage, and the vessel means has an outlet port formed in a bottom thereof for discharging the developer from the vessel means, the outlet port being positioned at an end zone of the developer circulating passage through which the developer propelled by one of the screw members is introduced into the other screw member.

Furthermore, according to the present invention, there is provided a developing device using a two-component developer composed of a toner component and a magnetic component, which comprises: a vessel means for holding the two-component developer; a magnetic roller means rotatably provided within the vessel means to entrain and bring the developer to a developing zone for a development of an electrostatic latent image; an agitator means provided in the vessel means for agitating and circulating the developer to cause a triboelectrification between the toner component and the magnetic component and a uniform distribution of the toner component in the magnetic component, the agitator means including at least two screw members arranged in parallel with each other to define a developer circulating passage; the vessel means has an outlet port formed in a bottom thereof for discharging the developer from the vessel means, the outlet port of the vessel means being positioned at a location along the developer circulating passage; and a slidable shutter means incorporated into the bottom of the vessel means so as to move a first position at which the slidable shutter means closes the outlet port and a second position at which the slidable shutter means opens the outlet port, wherein the slidable shutter means includes at least two shutter elements spaced from each other and securely connected to each other, and opposite side edges of each shutter element are slidably received in two side grooves which are formed in opposite side wall faces partially defining the outlet port of the vessel means, respectively, so as to form a labyrinth seal therebetween.

BRIEF DESCRIPTION OF THE DRAWINGS

Other objects and advantages of the present invention will be better understood from the following description, with reference to the accompanying drawings, in which.

DESCRIPTION OF THE PREFERRED EMBODIMENTS

Figure 1:
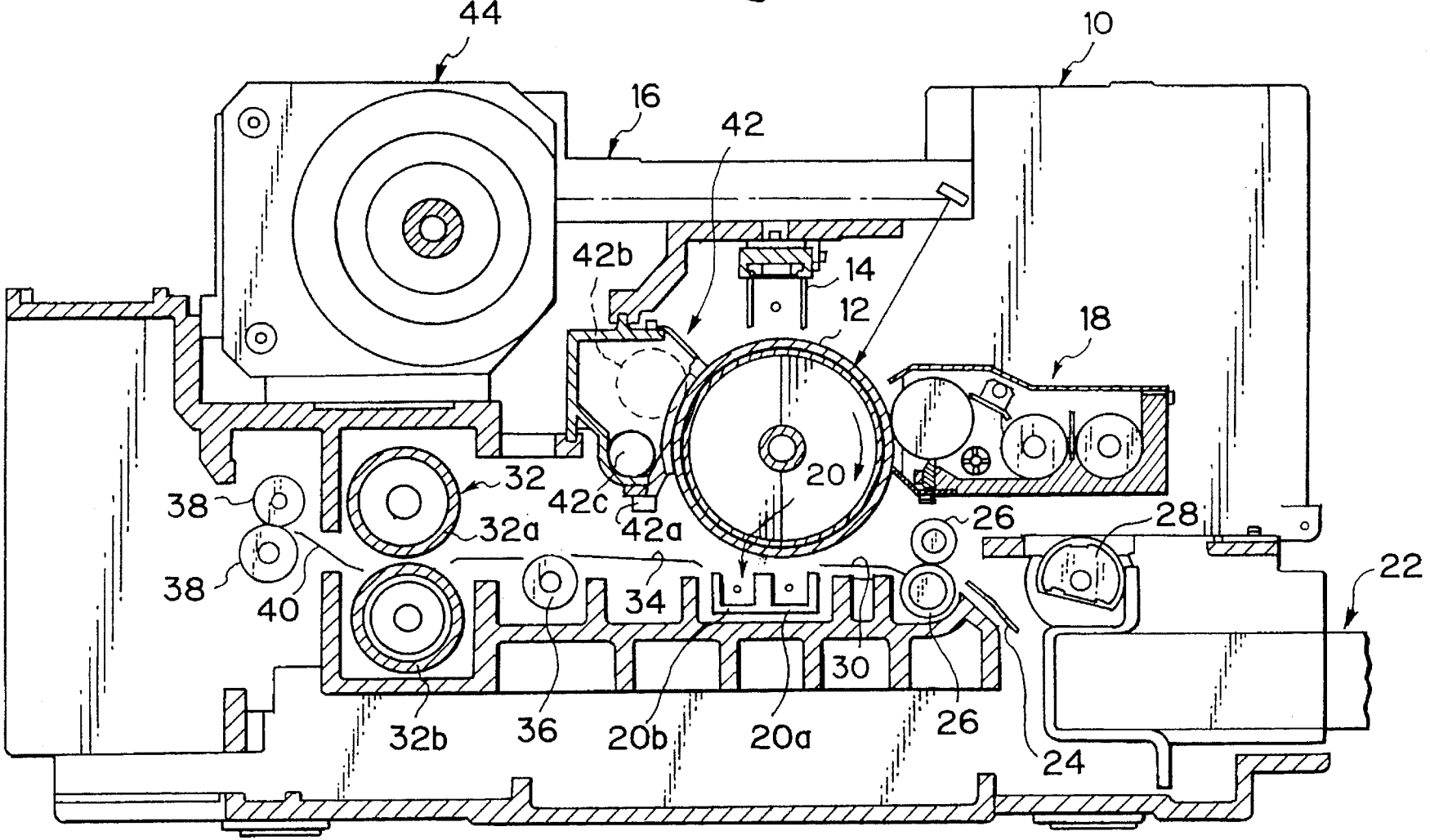
FIG. 1 is a schematic view showing an electrophotographic laser printer including a developing device constructed according to a first aspect of the present invention.

FIG. 1 schematically shows a laser printer as an example of an electrophotographic printer, in which the present invention is embodied. This printer comprises a printer housing 10, and a rotary photosensitive drum 12 formed as a latent image carrying body and housed in the printer housing 10. During an operation of the printer, the drum 12 is rotated in a direction indicated by an arrow in FIG. 1.

The printer also comprises an electric discharger 14 such as a corona discharger for producing a charged area on the photosensitive drum 12, and a laser beam scanner 16 is provided to write an electric latent image on the charged area of the drum 12. The laser beam scanner includes a laser source such as a semiconductor laser diode for emitting a laser light, an optical system for focusing the laser light into a laser beam LB, and an optical scanning system such as a polygon mirror for deflecting the laser beam LB along a direction of a central axis of the drum 12 so that the charged area of the drum 12 is scanned by the deflecting laser beam LB. During the scanning, the laser beam LB is switched on and off on the basis of binary image data obtained from, for example, a word processor, personal computer or the like, so that an electrostatic latent image is written as a dot image on the charged area of the drum 12. In particular, when a zone of the charged area is irradiated by the laser beam LB, the charges are released from the irradiated zone so that the latent image is formed as a potential difference between the irradiated zone and the remaining zone.

The printer further comprises a developing device 18 for electrostatically developing the latent image with a two-component developer composed of a toner component (colored fine resin particles) and a magnetic component (magnetic fine carriers). In the developing device 18, the developer is agitated so that the toner particles are electrically charged with a given polarity by a triboelectrification with the magnetic carriers, and the development of the latent image is carried out by an electrostatic attraction of the charged toner particles to the latent image, as mentioned in the "Description of the Related Prior Art".

Furthermore, the printer comprises a transfer charger assembly 20 for electrostatically transferring the developed toner image to a recording medium such as a cut sheet paper, which is introduced into a clearance between the photosensitive drum 12 and the transfer charger assembly 20. The transfer charger assembly 20 includes a transfer charger **20*a*, and an AC charge eliminator 20*b* disposed adjacent to the transfer charger 20*a*. The transfer charger, which may be a corona discharger, is subjected to an application of a DC electric energy to give the paper an electric charge having a polarity opposite to that of the electric charge of the developed toner image, whereby the toner image is electrostatically transferred from the drum 12 to the paper. The AC charge eliminator 20*b*, which also may be a corona discharger, is subjected to an application of an AC electric energy to partially eliminate the electric charge of the paper to which the toner image is transferred, whereby an electrostatic attraction acting between the paper and the drum can be weakened for an effective separation of the paper from the drum 12**.

The printer is provided with a paper cassette 22 in which a stack of paper is received, and a paper guide 24 extended from the paper cassette 22 toward a pair of register roller 26, 26. During the printing operation, papers to be printed are fed one by one from the paper cassette 22 along the paper guide 24 by driving a paper feeding roller 28 incorporated in the paper cassette 22. The fed paper is stopped once at the register rollers 26, 26, and is then introduced, at a given timing, into the clearance between the drum 12 and the assembly 20 through a paper guide 30 extended between the register rollers 26, 26 and the assembly 20, so that the developed toner image can be transferred to the paper in place.

The paper discharged from the clearance between the drum 12 and the assembly 20, i.e., the paper carrying the transferred toner image, is then moved toward a toner image fixing device 32 along a paper guide 34 extended between the assembly 20 and the fixing device 32 and having a paper guide roller 36 incorporated therein, and is passed through a nip between a heat roller **32*a* and a backup roller 32*b* of the fixing device 32, whereby the transferred toner image is thermally fused and fixed on the paper. The paper having the fixed toner image is fed to a pair of paper discharging rollers 38, 38 along a paper guide 40 extended between the fixing device 32 and the paper discharging rollers 38, 38, and is then discharged from the printer through the rollers 38, 38**.

The printer is also provided with a toner cleaner 42 having a charge eliminating lamp **42*a* attached thereon, and a fur brush 42*b* provided therein. The lamp 42*a* illuminates a surface of the drum 12 for eliminating the charges therefrom, and the fur brush 42*b* cleans the drum surface to remove residual toner particles not transferred to the paper in the transferring process. The toner cleaner 42 also has an outlet port 42*c* formed therein to discharge the removed toner particles therethrough, and the discharged toner particles are returned to the developing device 18 to be recycled. Note, in FIG. 1, reference numeral 44 indicates a main electric motor by which the drum 12, the developing device 18, the paper feeding roller 28, the register rollers 26, 26, the fixing device 32**, etc., are driven.

Figure 2:
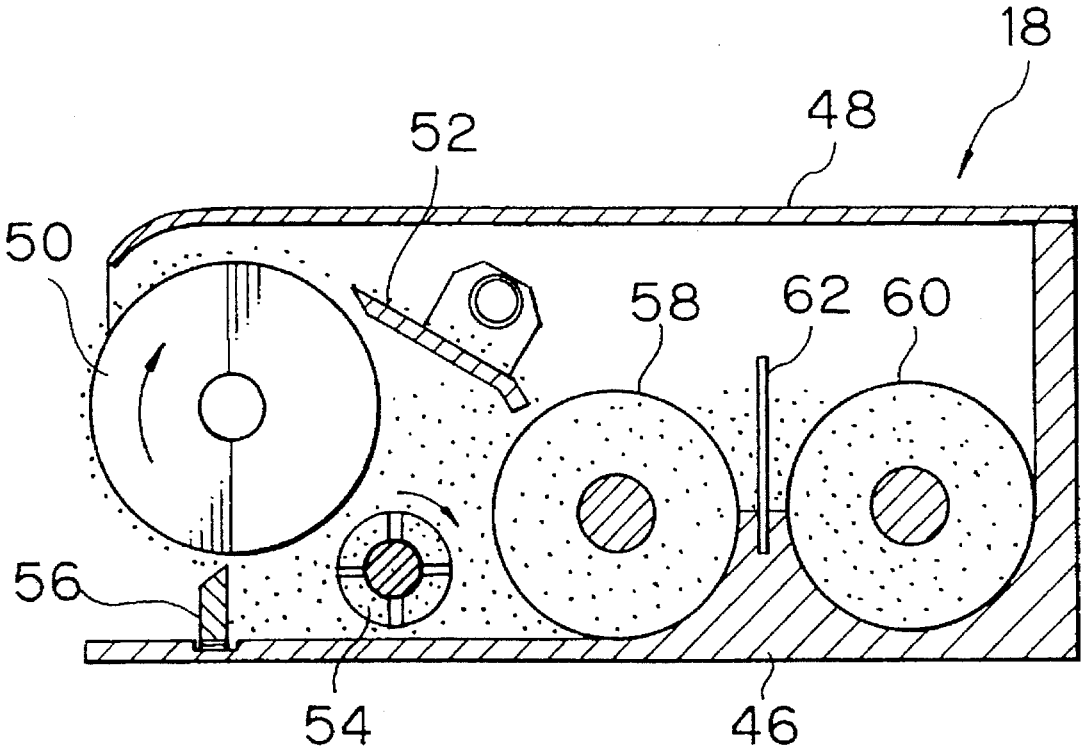
FIG. 2 is an enlarged schematic view of the developing device of the electrophotographic laser printer shown in FIG. 1.
Figure 3:
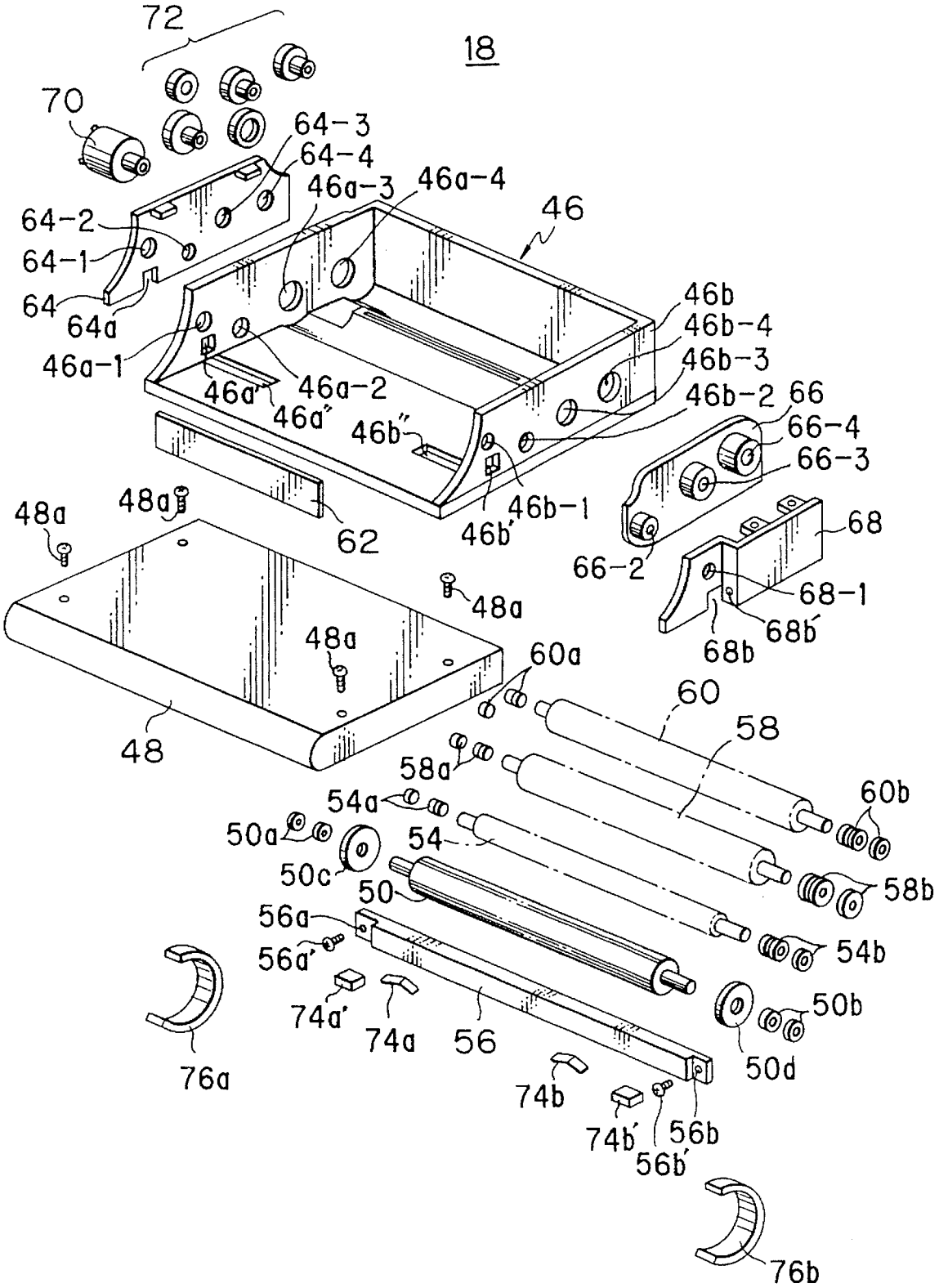
FIG. 3 is an exploded perspective view of the developing device shown in FIG. 2.
Figure 4:
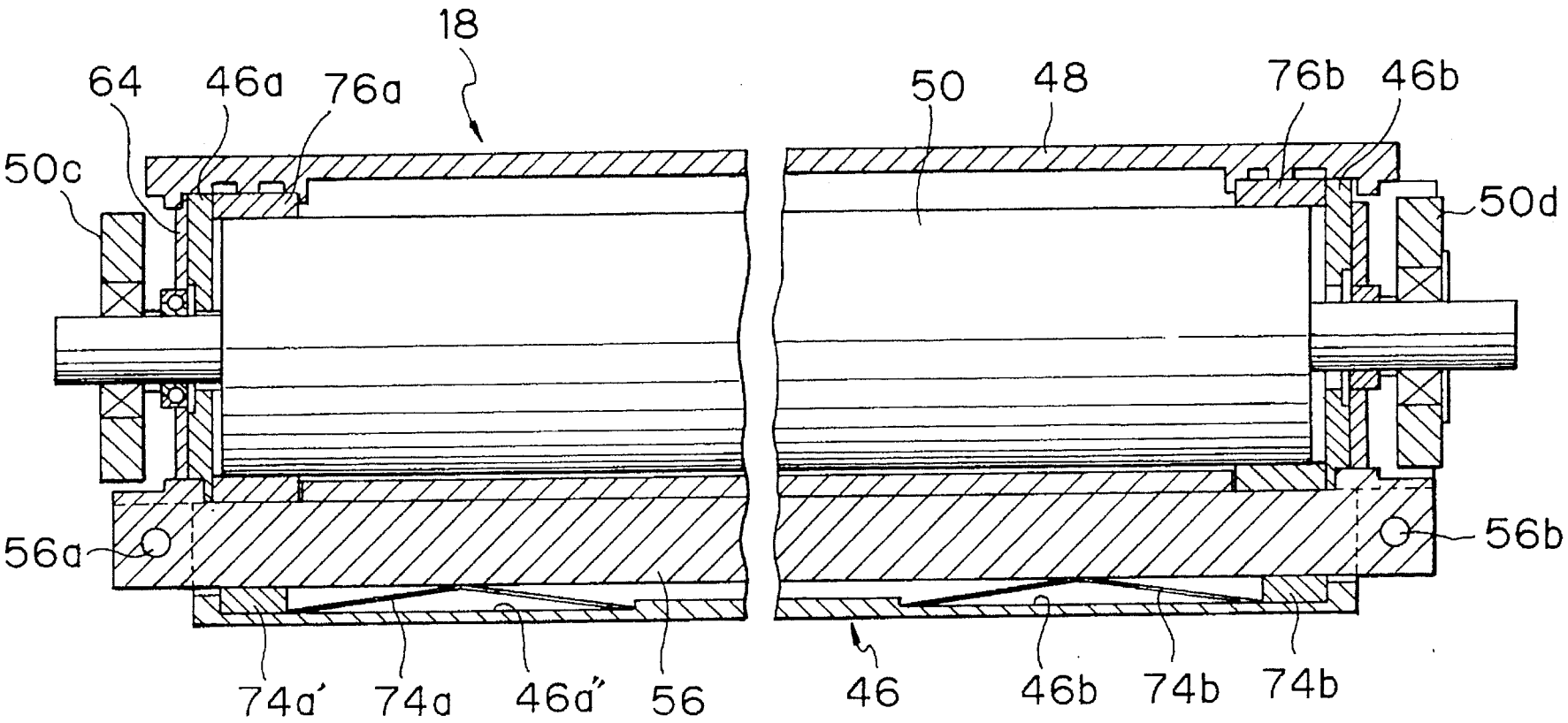
FIG. 4 is a cross-sectional view of the developing device of FIGS. 2 and 3, showing a positional arrangement of the magnetic roller and the doctor blade.

FIGS. 2, 3 and 4 show a first embodiment of the developing device 18 constructed according to a first aspect of the present invention. In this embodiment, although the developing device 18 is formed as a developer-circulation type developing device, the first aspect of the present invention may be embodied in another type developing device. The developing device includes a vessel 46 for holding the two-component developer, an existence of which is illustrated by a plurality of fine dots, and the vessel 46 is covered by a cover plate member 48, as shown in FIG. 2.

The developing device 18 also includes a developing roller or magnetic roller 50 rotatably provided in the vessel 46 in such a manner that a portion of the magnetic roller 50 is exposed therefrom and faces the photosensitive drum 12. The magnetic roller 50 has a rotatable sleeve formed of a nonmagnetic material such as aluminum, and bar-like permanent magnet elements immovably provided within and coextended with the sleeve. During operation of the developing device 18, only the sleeve is rotated in a direction indicated by an arrow in FIGS. 1 and 2, so that a part of the developer held in the vessel 46 is magnetically adhered to and entrained by the sleeve due to a production of magnetic fields by the bar-like permanent magnet elements. Thus, the entrained developer is brought toward a developing zone defined as a nip zone between the drum 12 and the magnetic roller 50 for the development of the latent image. The developer passed through the developing zone is removed from the magnetic roller 50 by a scraper blade 52 engaged therewith, and the removed developer is returned to the developer held in the vessel 46 so that a fresh part of the developer can be always entrained by the magnetic roller 50. Note, the developing device 18 may be provided with a paddle roller 54 disposed beside the magnetic roller 50 and rotated in a direction indicated in FIG. 2 for feeding the fresh part of the developer to the magnetic roller 50.

The developing device 18 is provided with a doctor blade 56 for uniformly regulating an amount of the developer entrained by the magnetic roller 50. In particular, the magnetic carriers are magnetically adhered to the magnetic roller 50 to form a magnetic brush having a plurality of fine spike-like elements, each of the spike-like elements consisting of the magnetic carriers magnetically connected to each other, and the toner particles are electrostatically adhered to the spike-like elements. Namely, the developer, or the toner component is entrained and brought by the spike-like elements to the developing zone. Accordingly, the uniform regulation of the amount of the developer entrained by the magnetic roller 50 can be carried out by making a length of the fine spike-like elements uniform with the doctor blade 56. Note, an attachment of the doctor blade 56 to the vessel 46 is performed according to the present invention, as mentioned, and an arrangement thereof is explained in detail hereinafter.

In this embodiment, the developing device 18 is also provided with a screw type agitator provided in the vessel 46 to agitate the developer held therein, to cause the triboelectrification between the toner component and the magnetic component. The agitator includes at least two screw members 58 and 60 disposed in parallel with each other by end walls of the vessel 46, and a partition member 62 provided between the two screw members 58 and 60 and extended therealong. In this embodiment, the screw members 58 and 60 are identical with each other, but these screw members are reversely rotated with respect to each other, so that respective developers entrapped by the screw members 58 and 60 are reversely propelled with respect to each other. The partition member 62 has a length shorter than that of the screw members 58 and 60, so that two developer passages defined by the screw members 58 and 60 are in communication with each other at the ends of the partition member 62, whereby a part of the developer propelled by one of the screw members 58, 60 is entrapped by the other screw member 58, 60. Namely, the developer passages form a developer-circulation passage. Thus, during an operation of the developing device 18, a part of the developer held in the vessel 46 is always circulated along the developer-circulation passage, whereby not only can the toner component be sufficiently charged by a triboelectrification with the magnetic component, but also a uniform distribution of the toner component in the magnetic component can be ensured.

FIG. 3 is an exploded perspective view in which main parts of the developing device 18 are illustrated. Note, in this drawing, a profile of the paddle roller 54 and profiles of the screw members 58 and 60 are shown by a chain-dot line for the sake of convenience. The vessel 46 is provided with opposed side walls **46*a* and 46*b* having four holes 46*a*-1 to 46*a*-4 and four holes 46*b*-1 to 46*b*-4 formed therein, and the holes 46*a*-1 to 46*a*-4 and the holes 46*b*-1 to 46*b*-4 are in alignment with each other, respectively, as is apparent from FIG. 3. The vessel 46 is also provided with three support plates 64, 66, and 68: one support plate 64 is securely attached to an outer face of the side wall 46*a* by screw bolts (not shown); and the other two support plates 66 and 68 are securely attached to an outer face of the side wall 46*b* by screw bolts (not shown). The support plate 64 has four holes 64-1 to 64-4 formed therein and aligned with the holes 46*a*-1 to 46*a*-4, respectively, and the support plate 66 has three holes 66-2 to 66-4 formed therein and aligned with the holes 46*b*-2 to 46*b*-4. The support plate 68 has a hole 68-1 formed therein and aligned with the hole 46*b*-1**.

One shaft end of the magnetic roller 50 is inserted through the holes **46*a*-1 and 64-1, and is rotatably supported by bearing elements 50*a*. The other shaft end of the magnetic roller 50 is inserted through the holes 46*b*-1 and 68-1, and is rotatably supported by bearing elements 50*b*. Note, references 50*c* and 50*d* indicate gear elements which are mounted on the shaft ends of the magnetic roller 50. One shaft end of the paddle roller 54 is inserted through the holes 46*a*-2 and 64-2, and is rotatably supported by bearing elements 54*a*. The other shaft end of the paddle roller 54 is inserted through the holes 46*b*-2 and 66-2, and is rotatably supported by bearing elements 54*b*. One shaft end of the screw member 58 is inserted through the holes 46*a*-3 and 64-3, and is rotatably supported by bearing elements 58*a*. The other shaft end of the screw member 58 is inserted through the holes 46*b*-3 and 66-3, and is rotatably supported by bearing elements 58*b*. One shaft end of the screw member 60 is inserted through the holes 46*a*-4 and 64-4, and is rotatably supported by bearing elements 60*a*. The other shaft end of the screw member 60 is inserted through the holes 46*b*-4 and 66-4, and is rotatably supported by bearing elements 60*b*. The partition member 62 is securely implanted in an elongated slot 46*c* formed in a ridge portion raised from a bottom of the vessel 46. Note, in FIG. 3, reference 70 indicates an electric motor such as a stepping motor attached to the support plate 64, and reference 72 indicates a gear train operatively connected to the motor 70 and associated with the corresponding shaft ends of the magnetic roller 50, paddle roller 54, and screw members 58 and 60** for rotation of these elements.

For the attachment of the doctor blade 56 to the vessel 46, the side walls **46*a* and 46*b* have rectangular openings 46*a*' and 46*b*' formed therein in the vicinity of the bottom of the vessel 46, and these openings 46*a*' and 46*b*'** are in alignment with each other.

Also, the bottom of the vessel 46 has two groove sections **46*a*" and 46*b*" formed in an upper surface thereof, and these groove sections are extended inward from locations at which the holes 46*a*' and 46*b*' are disposed, respectively. Further, the support plate 64 has a rectangular opening 64*a* formed therein, this opening 64*a* being in register with the hole 46*a*', and the support plate 68 has a rectangular opening 68*b* formed therein, this opening 68*b* being in register with the hole 46*b*'**.

Each of the rectangular openings **64*a*, 46*a*', 46*b*' and 68*b* has a somewhat larger size than that of a cross-section of the doctor blade. Accordingly, when the doctor blade 56 is arranged in such a manner that the ends thereof are inserted into the openings 46***a'* and 64*a* and the openings holes 46*b'* and 68*b*, respectively, the doctor blade 56 is somewhat movable upward and downward. The formation of the rectangular openings 64*a*, 46*a'*, 46*b'* and 68*b* is carried out in such a manner that these openings have precise dimensions and are accurately positioned with respect each other. Especially, in this embodiment, an upper edge, by which each of the openings 64*a*, 46*a'*, 46*b'* and 68*b* is partially defined, is accurately positioned with respect to a rotational axis of the magnetic roller 50. Thus, when two V-shaped leaf springs 74*a* and 74*b* are provided in the groove sections 46*a"* and 46*b'* such that these leaf springs 74*a* and 74*b* are constrained between a lower side of the doctor blade 56 and bottom surfaces of the groove sections 46*a"* and 46*b"*, as shown in FIG. 4, the doctor blade 56 is resiliently abutted against the upper edges of the openings 64*a*, 46*a'*, 46*b'* and 68*b*, whereby it is possible to obtain a given precise clearance between the magnetic roller 50 and the doctor blade 56.

Thereafter, the doctor blade 56 is securely attached to the support plates 64 and 68 at the ends thereof. In particular, the ends of the doctor blade 56 have smooth holes 56*a* and 56*b* formed therein, and each of these holes 56*a* and 56*b* has a somewhat larger size than that of a corresponding screw bolts 56*a'*, 56*b'* (FIG. 3). The support plate 64 has a tongue-like element (not visible in FIG. 3) perpendicularly extended from the outer face thereof at a side edge by which the opening 64*a* is partially defined, and the screw bolt 56*a'* is screwed into a threaded hole formed in the not visible tongue-like element. On the other hand, the screw bolt 56*b'* is screwed into a threaded hole 68*b'* formed in a shoulder portion of the support plate 68, as shown in FIG. 3. The positional relationship between the magnetic roller 50 and the doctor blade 56 cannot be disturbed by tightening the screw bolts 56*a'* and 56*b'*, because each of the smooth holes 56*a* and 56*b* has a somewhat larger size than that of the corresponding screw bolts 56*a'*, 56*b'*, as mentioned above.

As apparent from the foregoing, according to the first aspect of the present invention, the doctor blade 56 can be precisely attached to the vessel 46 by only the resilient abutment of the doctor blade 56 against the upper edges of the openings 64*a*, 46*a'*, 46*b'* and 68*b*. Namely, it is possible to easily carry out the precise attachment of the doctor blade 56 to the vessel 46 without any fine positional adjustment of the doctor blade 56 with respect to the magnetic roller 50.

As shown in FIG. 4, two seal elements 74*a'* and 74*b'* are disposed in the groove sections 46*a"* and 46*b"* in the vicinity of the openings 46*a'* and 46*b'*, respectively, so as to prevent a leakage of the developer through the opening 46*a'*, 46*b'*. When the seal elements 74*a'* and 74*b'* is formed of a resilient material such as rubber, sponge or the like, a resilient force thereof may be used for the resilient abutment of the doctor blade 56 against the upper edges of the openings 64*a*, 46*a'*, 46*b'* and 68*b*. In this case, of course, the leaf springs 74*a* and 74*b* may be omitted.

After the various parts are assembled in the vessel 46, the cover plate member 48 is securely mounted by screw bolts 48*a* (FIG. 3). In FIGS. 3, and 4, references 76*a* and 76*b* indicate annular seal elements applied to the ends of the magnetic roller 50 for preventing a leakage of developer through narrow spaces which are formed between the end faces of the magnetic roller 50 and the inner wall faces of the side walls 46*a* and 45*b*. Note, the real elements 76*a* and 76*b* may be formed of a suitable material such as sponge.

Figure 5:
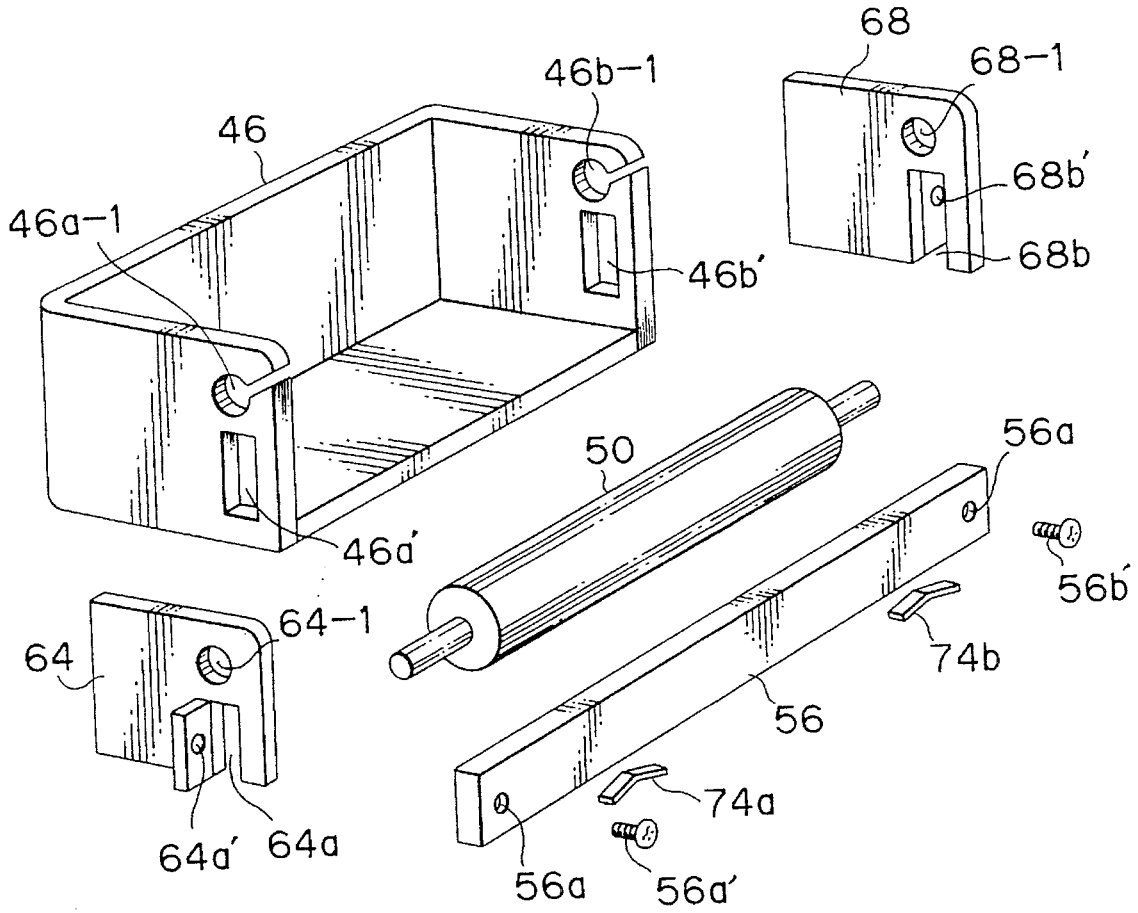
FIG. 5 is a perspective view showing a constructional principle of the developing device shown in FIGS. 2 to 4.

FIG. 5 shows a constructional principle of the arrangement as mentioned above. In this drawing, the same references as in FIGS. 3 and 4 represent the same elements. Note, reference 64*a'* indicates the threaded hole formed in the tongue-like element (not visible in FIG. 3), and the screw bolt 56*a'* is screwed into the threaded hole 64*a'* through the smooth hole 56*a* for the attachment of the doctor blade 56.

In the embodiment as mentioned above, although the doctor blade 56 is resiliently abutted against all of the upper edges of the openings 64*a*, 46*a'*, 46*b'* and 68*b*, only one set of the upper edges of the openings 64*a* and 68*b* or the openings 46*a'* and 46*b'* may be utilized for positioning the doctor blade 56 with respect the magnetic roller 50. For example, when the set of the upper edges of the openings 64*a* and 68*b* is selected for positioning the doctor blade 56 with respect the magnetic roller 50, the other set of the upper edges of the openings 46*a'* and 46*b'* is located at a higher level than that of the upper edges of the openings 64*a* and 68*b*, and vice versa.

Figure 6:
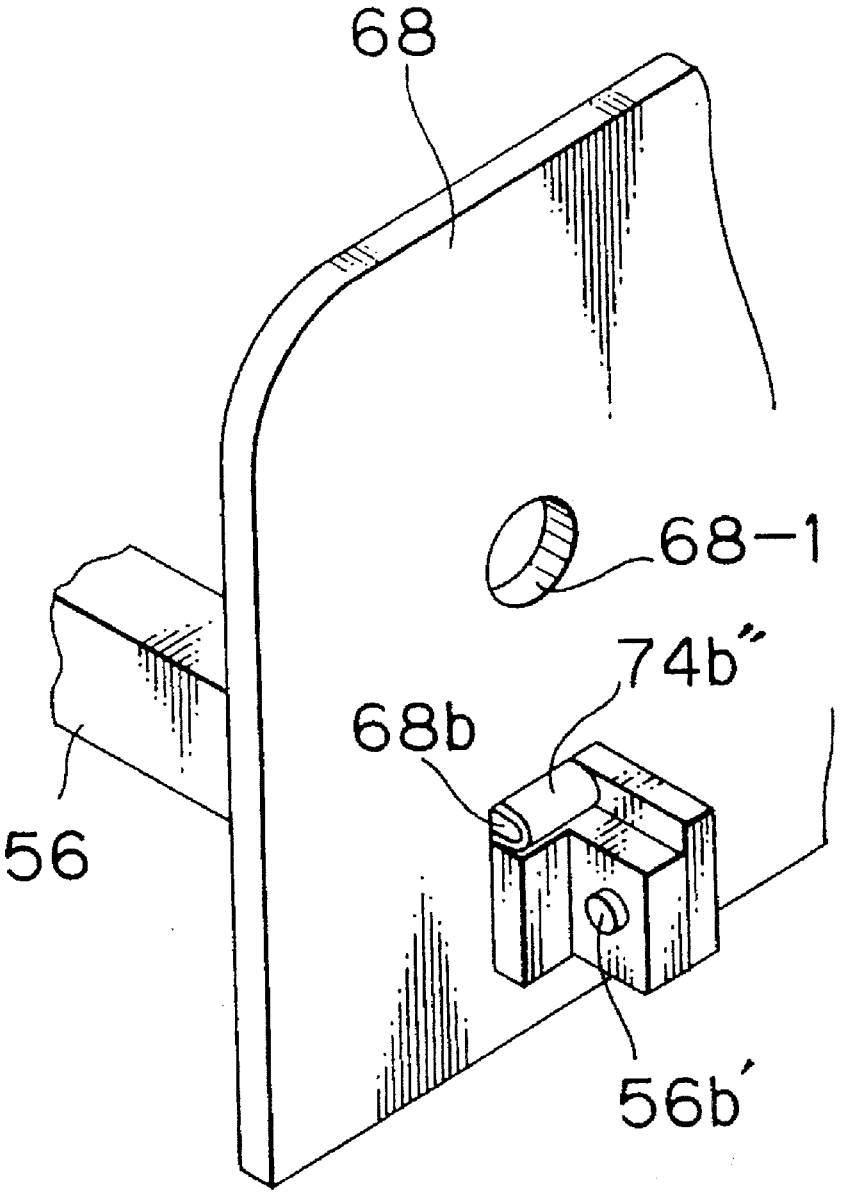
FIG. 6 is a perspective view showing a modification of the embodiment as shown 2 to 4.

FIG. 6 shows a modification of the embodiment as mentioned above. In this modified embodiment, a lower edge of the opening 68*b* is utilized for positioning the doctor blade 56 with respect the magnetic roller 50. Of course, the same is true for the opening 64*a* and/or the openings 46*a'* and 46*b*∝. In FIG. 6, reference 74*b"* indicates a V-shaped leaf spring inserted in a space formed between the upper end side of the doctor blade 56 and the upper edge of the opening 68*b* for resiliently abuting the doctor blade 56 against the lower edge of the opening 68*b*.

FIGS. 7 to 10 show a second embodiment of the developing device 18 constructed according to a second aspect of the present invention. In this embodiment, the developing device 18 is formed as a developer-circulation type developing device, and is constructed in substantially the same manner as the above-mentioned first embodiment. Note, in FIGS. 7 to 10, the features similar to those of FIGS. 2 to 4 are indicated by the same references.

Figure 7:
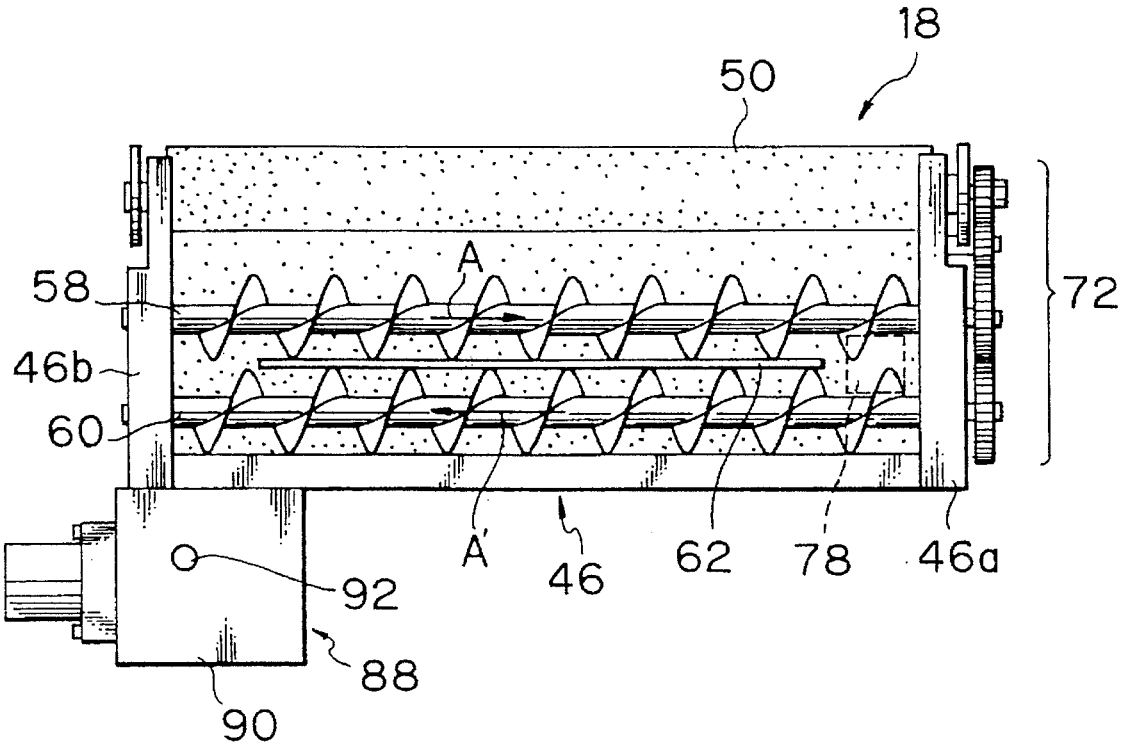
FIG. 7 is a plane view of a developing device constructed according to a second aspect of the present invention.

As shown in FIG. 7, each of the screw members 58 and 60 is provided with a right-hand flight as shown in FIG. 2. Accordingly, when the screw member 54*a* is rotated in the clockwise direction as indicated by an arrow shown in FIG. 7, a developer entrapped thereby is propelled in a direction indicated by an arrow A, and, when the screw member 60 is rotated in the counterclockwise direction as indicated by an arrow shown in FIG. 7, a developer entrapped thereby is propelled in the reverse direction indicated by an arrow A'. As mentioned hereinbefore, the partition member 62 has a length shorter than that of the screw members 58 and 60, so that the two developer passages defined by the screw members 58 and 60 are in communication with each other at the ends of the partition member 62, whereby a part of the developer propelled by one of the screw members 58, 60 is entrapped by the other screw member 58, 60. Namely, the developer passages forms a developer-circulation passage, and, during an operation of the developing device 18, a part of the developer held in the vessel 46 is always circulated along the developer-circulation passage, whereby not only can the toner component be sufficiently charged by a triboelectrification with the magnetic component, but also a uniform distribution of the toner component in the magnetic component can be ensured.

As apparent from the foregoing discussed with reference to the "Description of the Related Art", the developer held in the vessel 46 must be periodically exchanged with new developer due to a deterioration of the magnetic component thereof, and as much of the developer as possible should be discharged from the vessel 46 as much as possible so that a premature deterioration of the exchanged new developer can be prevented. According to the second aspect of the present invention, an outlet port 78 for discharging the developer from the vessel 46 is formed in a bottom thereof, and is located at an end zone of the developer-circulation passage, as shown in FIG. 7, through which the developer propelled by one of the screw members 58, 60 is transferred to the other screw member 58, 60. With this arrangement, the developer can be discharged from the vessel 46 through the outlet port 78 so that a residual part of the developer is substantially reduced. In particular, if the outlet port 78 is located at another zone except for the end zone of the developer-circulation passage, e.g., a developer-passage zone defined by the screw member 58, 60, a relatively large amount of the developer is stagnated at the end zone of the developer-circulation passage at an ending of the discharge of developer, because a propellant force produced by the screw member 58, 60 cannot be directed straight toward the end zone of the developer-circulation passage. Nevertheless, according to the second aspect of the present invention, a substantial reduction of the residual part of the developer can be obtained due to the fact that the outlet port 78 is located at the end zone of the developer circulation passage.

Figure 8:
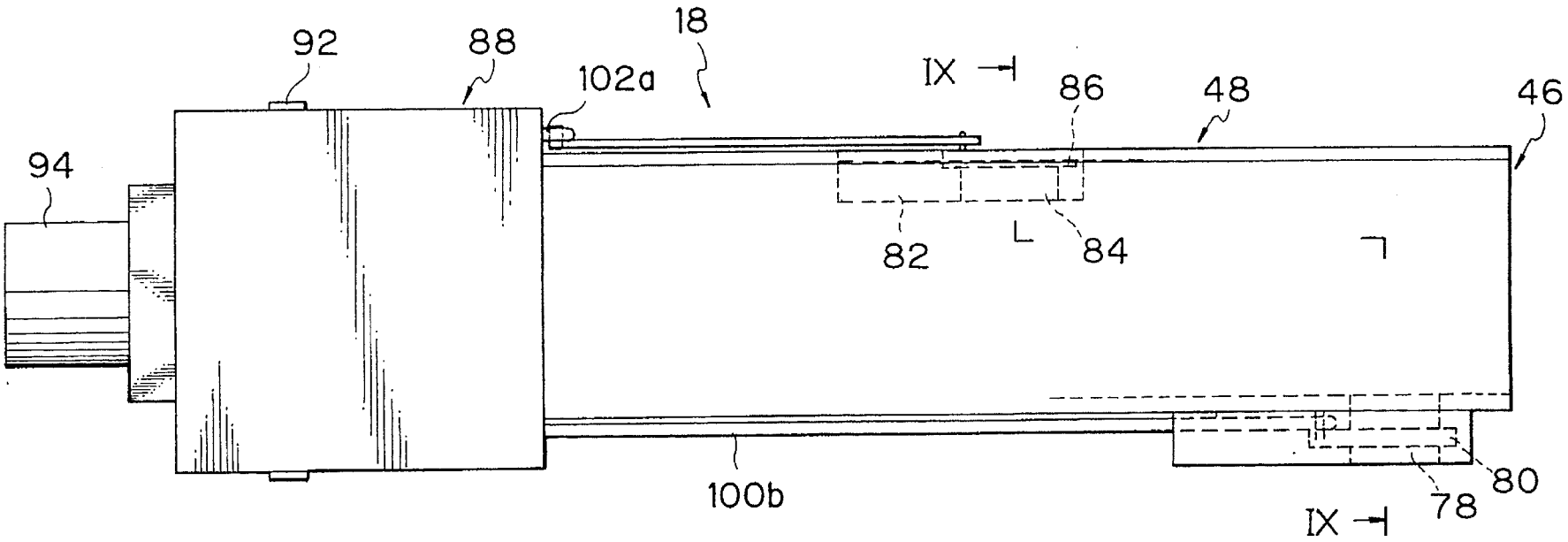
FIG. 8 is a rear view of the developing device shown in FIG. 7.
Figure 9:
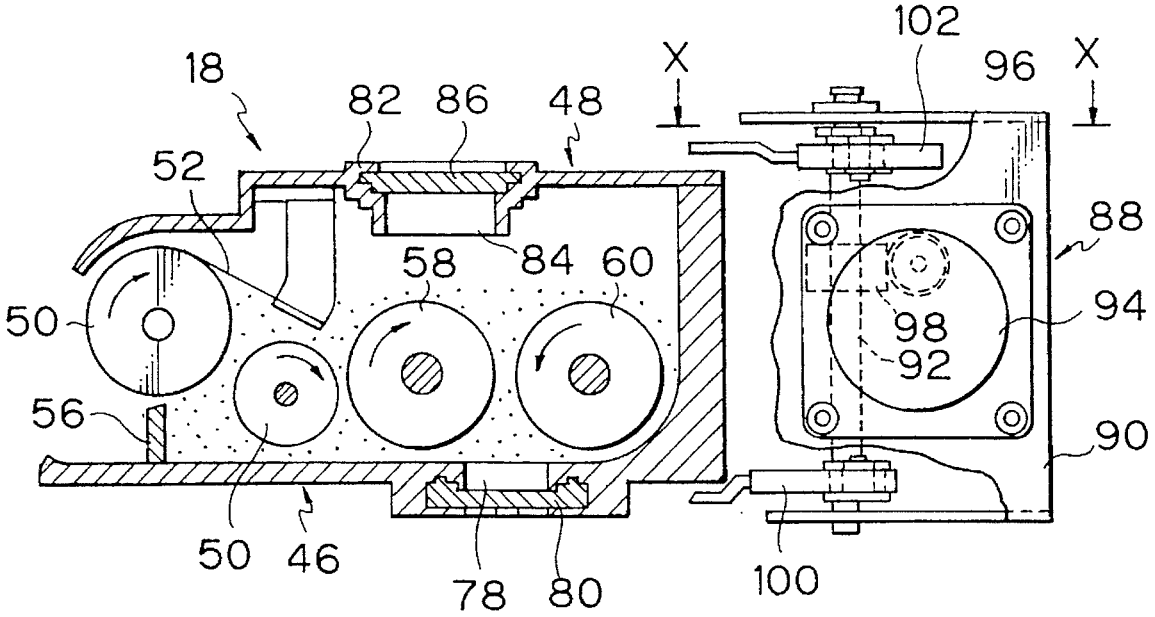
FIG. 9 is a cross-sectional view taken along line IX—IX of FIG. 8.

As apparent from FIGS. 8 and 9, the bottom of the vessel 46 is locally thickened at the end zone of the developer circulation passage, and the outlet port 78 is formed in the thickened portion of the vessel bottom. A slidable shutter element 80 is incorporated in the thickened portion of the vessel bottom such that opposite side edges thereof are slidably received in two side grooves formed in opposite side wall faces of the outlet port 78, whereby the shutter element 80 is movable between a first position at which the shutter element 80 closes the outlet port 78 and a second position at which the shutter element 80 opens the outlet port 78. Also, the cover plate member 48 has an opening formed in a central zone thereof, and a guide member 82 is integrally incorporated in the opening and has an inlet port 84 formed therein, as apparent from FIGS. 8 and 9. A slidable shutter element 86 is incorporated in the guide member 82 such that opposite side edges thereof are slidably received in two side grooves formed in opposite side wall faces of the inlet port 84, whereby the shutter element 86 is movable between a first position at which the shutter element 86 closes the outlet port 84 and a second position at which the shutter element 86 opens the outlet port 84.

Figure 10:
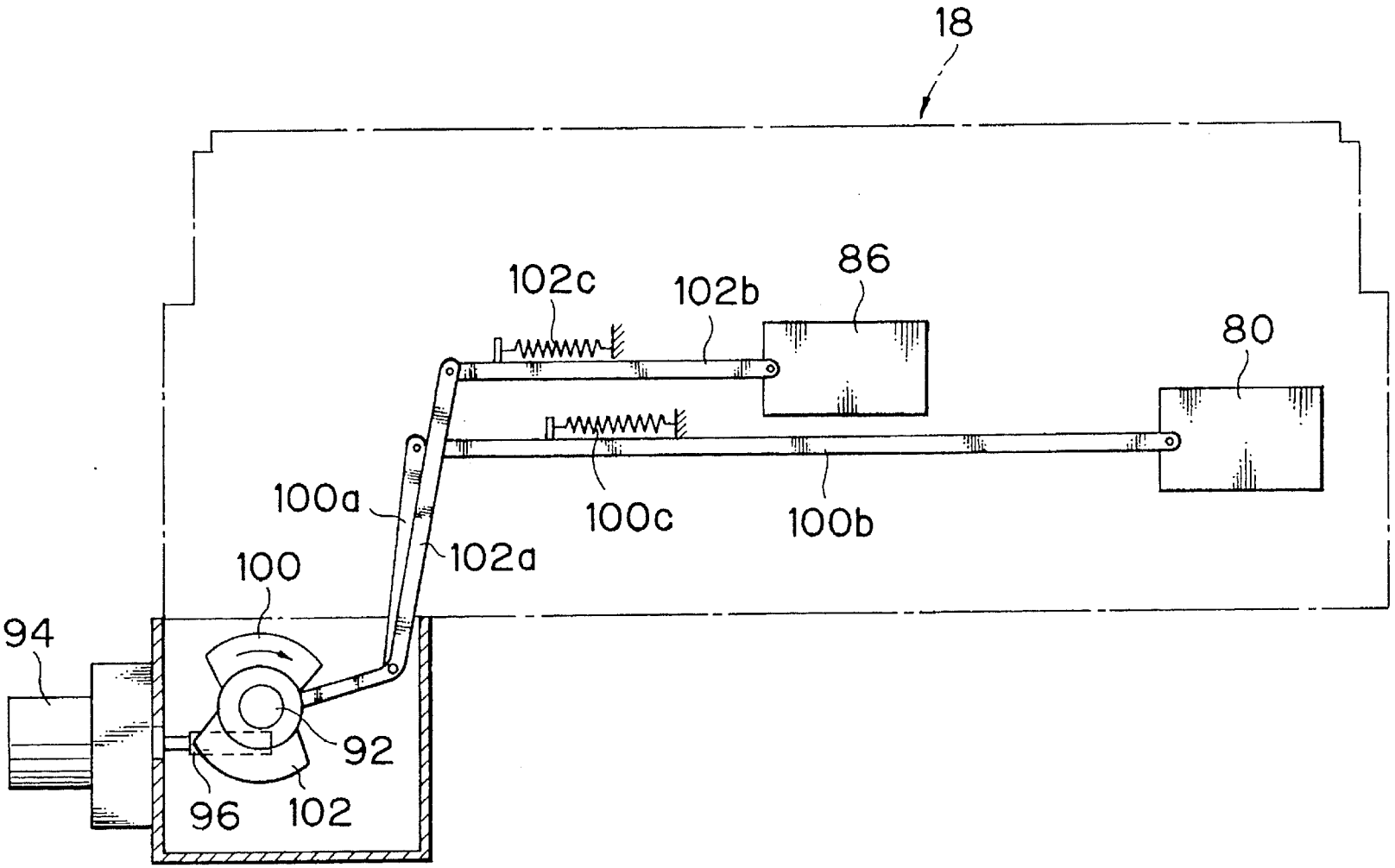
FIG. 10 is a cross-sectional view taken along line X—X of FIG. 9.

The vessel 46 is provided with an actuator assembly 88 for selectively driving the shutter elements 80 and 86, and the actuator assembly 88 includes a box-like frame 90 supported by the vessel 46, a shaft member 92 vertically extended through and rotatably supported by the box-like frame 90, and a stepping motor 94 attached to the box-like frame 90 for rotationally driving the shaft member 92. The stepping motor 94 has a worm gear 96 fixed on an output shaft thereof, and the shaft member 92 has a gear 98 fixed thereon and engaged with the worm gear 96. The actuator assembly 88 also includes lower and upper cams 100 and 102 fixed on the shaft member 92, and each of these cams has a sector-shaped configuration, as shown in FIG. 10. The sector-shaped cams 100 and 102 are substantially identical to each other, but these cams are diametrically opposite with respect to each other, i.e., a phase of the cam 100 is shifted with respect to that of the cam 102 by an angle of 180 degrees.

The actuator assembly 88 further includes lower and upper two-armed levers 100*a* and 102*a* pivoted to upper and lower frame sections of the box-like frame 90, respectively. As shown in FIG. 10, one arm of the lower lever 100*a* is engaged with the lower cam 100 at the end thereof, and the other arm thereof is pivoted at an end of a connecting rod 100*b*, the other end of which is pivoted to the slidable shatter element 80. Similarly, one arm of the upper lever 102*a* is engaged with the upper cam 102 at the end thereof, and the other arm thereof is pivoted at an end of a connecting rod 102*b*, the other end of which is pivoted to the slidable shatter element 86. The connecting rod 100*b* is provided with a tension spring 100*c*, one end of which is connected to the connecting rod 100*b*, and the other end thereof is fixed at a suitable location with respect to the bottom of the vessel 46, whereby the shutter element 80 is resiliently biased toward the closed position thereof. Similarly, the connecting rod 102*b* is provided with a tension spring 102*c*, one end of which is connected to the connecting rod 102*b*, and the other end thereof is fixed at a suitable location with respect to the cover plate member 48, whereby the shutter element 86 is resiliently biased toward the closed position thereof. Note, in FIGS. 8, 9 and 10, the shutter elements 80 and 86 are at the closed portions, respectively.

When the shaft member 92 is rotated by the stepping motor 94 in the clockwise direction as indicated by an arrow in FIG. 10, the lower lever 100*a* is rotated in the counterclockwise direction against a resilient force of the tension spring 100*c*, so that the shutter element 80 is moved from the closed position toward the open position. When the lower lever 100*a* is engaged with an arcuate cam face of the lower cam 100, the shutter element 80 reaches the open position. After the lower lever 100*a* is disengaged from the arcuate cam face of the lower cam 100, the shutter element 80 is moved the open position toward the closed position due to the resilient force of the tension spring 100*c*. When the shaft member 92 is rotated over an angle of 180 degrees, the shutter element 80 is returned to the closed position. When the shaft member 92 is further rotated, the upper lever 102*a* is then rotated in the counterclockwise direction against a resilient force of the tension spring 102*c*, so that the shutter element 86 is moved from the closed position toward the open position. When the upper lever 102*a* is engaged with an arcuate cam face of the upper cam 102, the shutter element 86 reaches the open position. After the upper lever 102*a* is disengaged from the arcuate cam face of the lower cam 100, the shutter element 86 is moved the open position toward the closed position due to the resilient force of the tension spring 102*c*. When the shaft member 92 is rotated over an angle of 360 degrees, the shutter element 80 is returned to the closed position.

Figure 11:
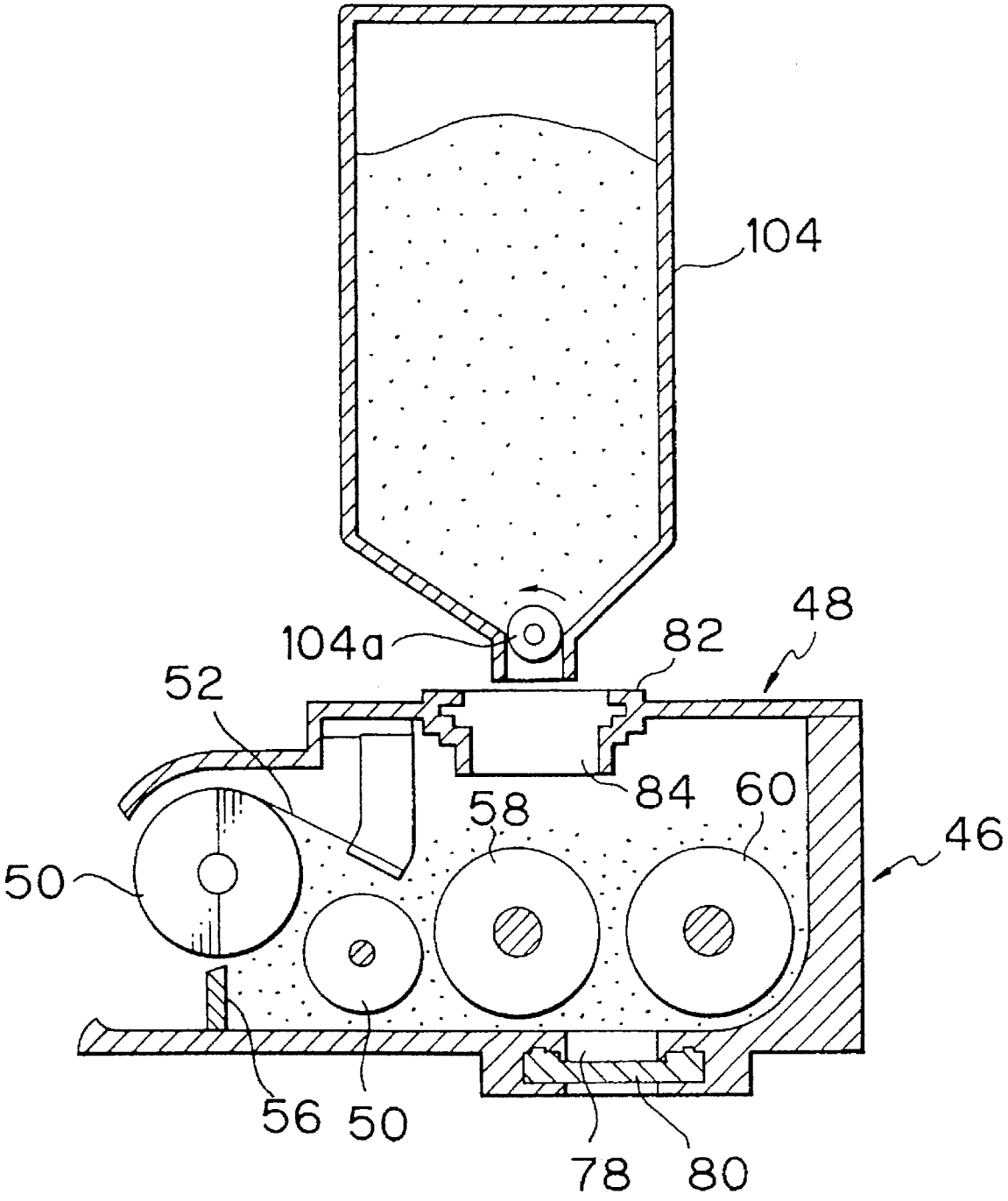
FIG. 11 is a cross-sectional view corresponding to FIG. 9, showing a toner supplier coupled to an inlet port of the developing device.

When the toner component is supplemented to the developer held in the vessel 46, a cartridge type toner supplier 104 is coupled to the inlet port 84 through a detachable adapter (not shown), as shown in FIG. 11. Then, the shutter element 86 is moved from the closed position to the open position, as mentioned above. The toner supplier 104 has a sponge roller element 104*a* provided at a discharge port thereof, and the roller element 104*a* is rotated to supplement the toner component to the developer held in the vessel 46, if necessary. For example, a permeameter (not shown) is incorporated in the bottom of the vessel 46 to measure a magnetic permeability of the developer which represents a content of the toner component in the developer, and the rotation Of the roller element 104*a* is regulated in accordance with an signal output from the permeameter, so that a ratio of the toner component to the developer can be made to fall within a given range.

Figure 12:
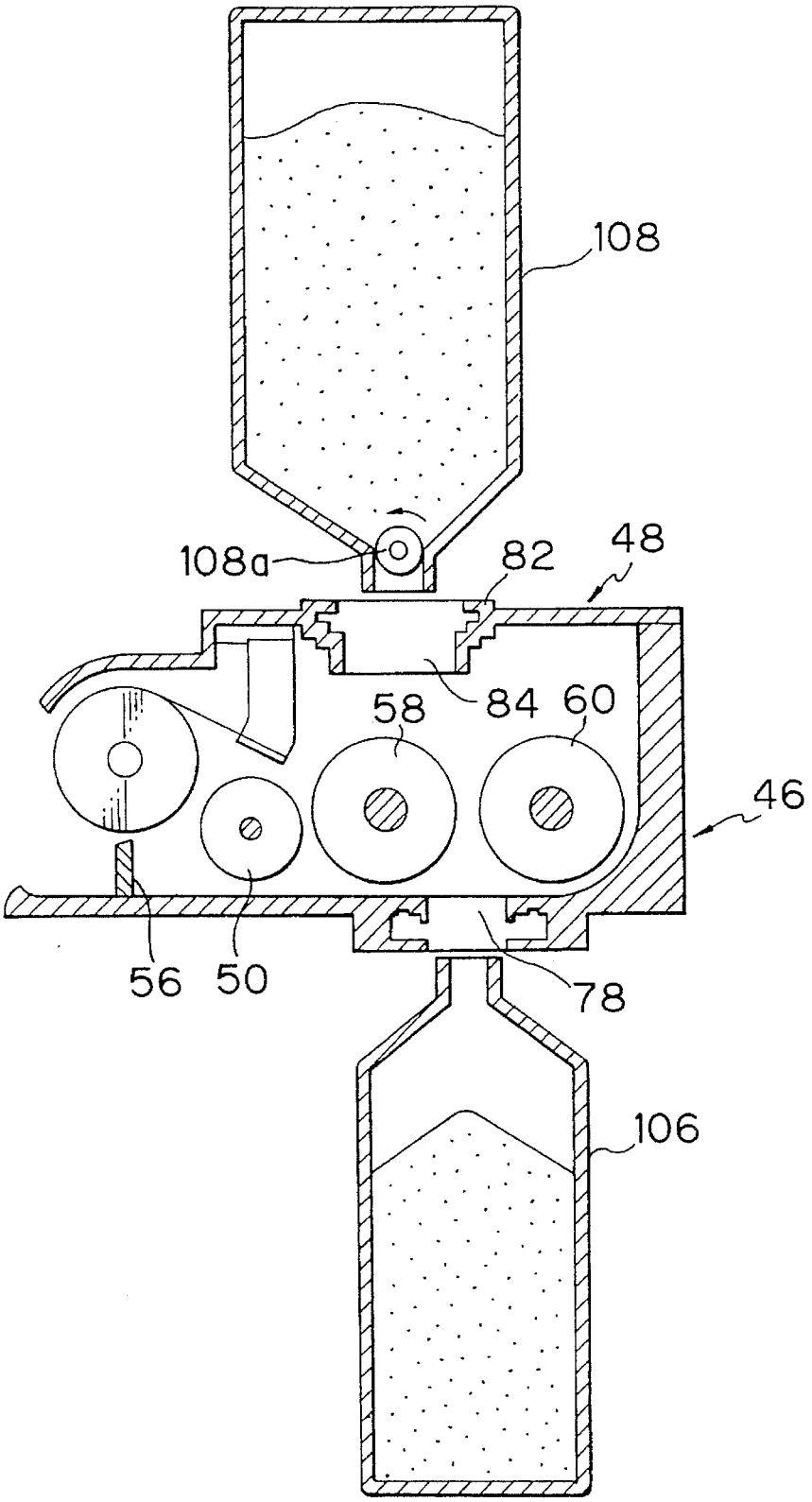
FIG. 12 is a cross-sectional view corresponding to FIG. 9, showing an empty container and a developer supplier coupled to outlet and inlet ports of the developing device.

When the old developer held in the vessel 46 is replaced by new developer, an empty container 106 is coupled to the outlet port 78 through a detachable adapter (not shown), as shown in FIG. 12. The shutter element 80 is moved from the closed position to the open position. Then, the screw members 58 and 60 are rotated so that the developer is discharged from the vessel 46 into the empty container 106 through the outlet port 78. After the discharge of the old developer is completed, the shutter element 80 is returned from the open position to the closed position. Then, a cartridge type developer supplier 108 is coupled to the inlet port 84 through a detachable adapter (not shown), as shown in FIG. 12, and the shutter element 86 is moved from the closed position to the open position. The developer supplier 108 has a sponge roller element 108*a* provided at an discharge port thereof, and the roller element 108*a* is rotated so that a new developer is fed from the developer supplier 108 to the vessel 46.

Figure 13:
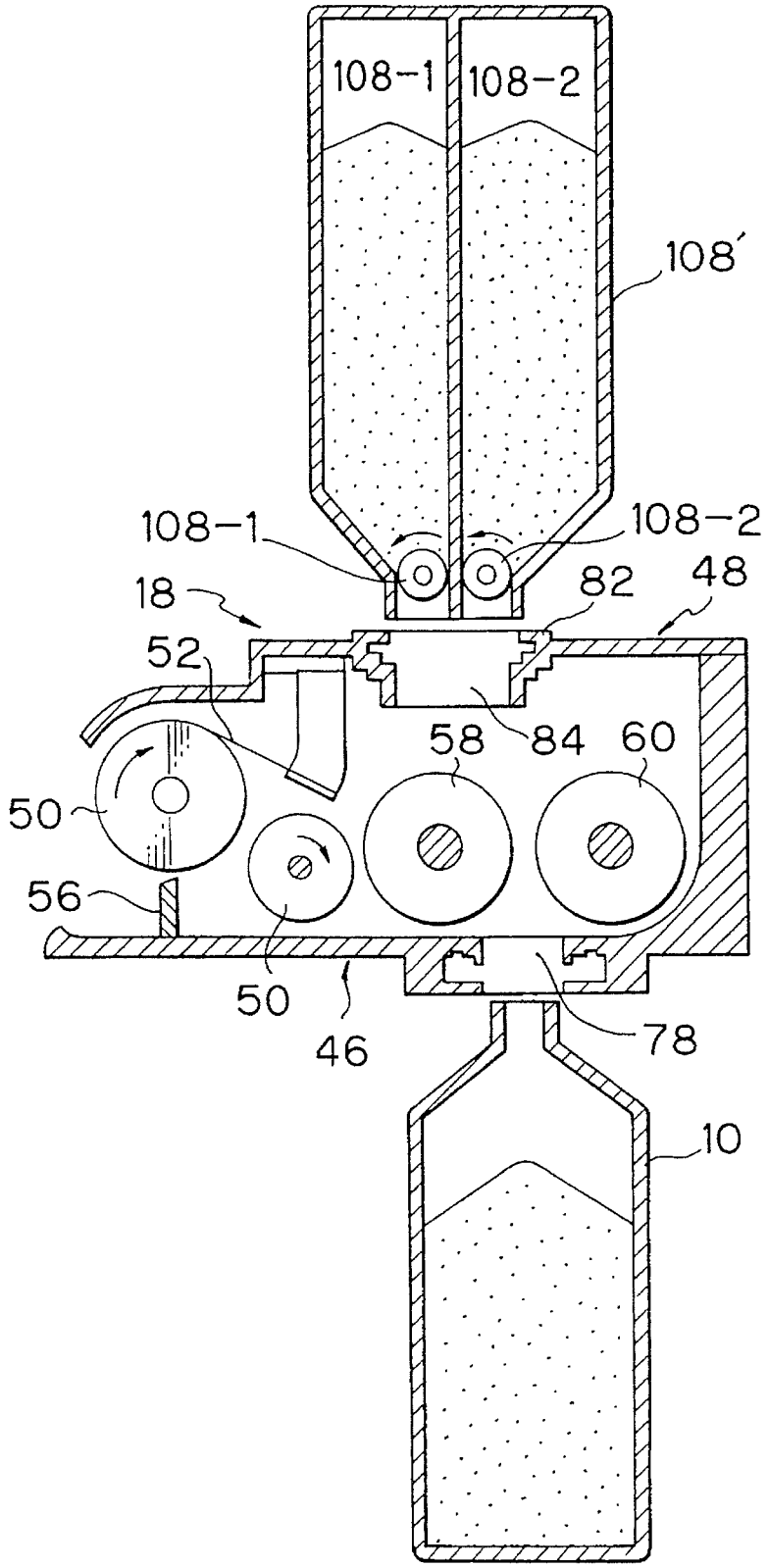
FIG. 13 is a cross-sectional view corresponding to FIG. 9, showing a modification of the embodiment as shown in FIG. 12.

Another type developer supplier 108' may be used in place of the supplier 108, as shown in FIG. 13. An interior of the supplier 108' is divided into two chambers 108-1 and 108-2 by a partition wall provided therein, and the chambers 108-1 and 108-2 hold the toner component and the magnetic component, respectively. Also, the supplier 108' has two sponge roller elements 108-1' and 108-2' provided in discharge ports of the chambers 108-1 and 108-2, respectively. Each of the roller elements 108-1' and 108-2' is independently rotated in accordance with a signal output from the above-mentioned permeameter, so that a ratio of the toner component to the new developer is adjustable.

Figure 14:
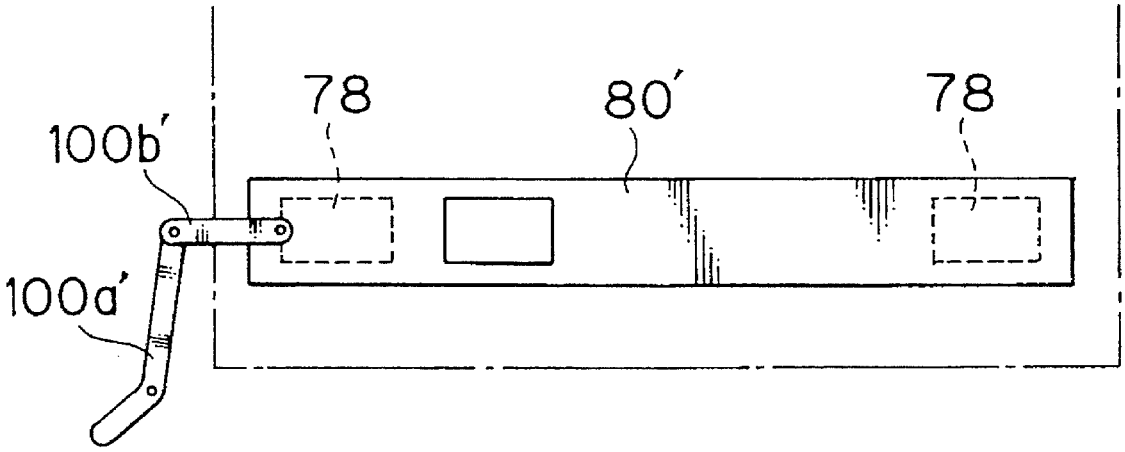
FIG. 14 is a plane view showing a modified part of the embodiment as shown in FIGS. 8 to 10.

In the second embodiment as mentioned above, although the outlet port 78 for discharging the developer from the vessel 46 is formed at only one end zone of the developer-circulation passage, as shown in FIG. 7, another outlet port may be formed at the other end zone of the developer-circulation passage, so that not only can the discharge of the old developer from the vessel 46 be facilitated, but also a residual part of the old developer in the vessel 46 can be further reduced. In this case, an elongated shutter element 80' may be used as shown in Fig. Note, in this drawing, the bottom of the vessel is partially shown by a chain-dot line. The shutter element 80' is slidable between a closed position at which the element 80' closes the outlet ports 78, 78 and an open position at which the element 80' opens the two outlet ports 78, 78. In FIG. 14, references 100*a'* and 100*b'* indicate a two-armed lever and a connecting rod corresponding the features 100*a* and 100*b* shown in FIG. 10, so that the shutter element 80' can be moved between the closed position and the open position in substantially the same manner as in FIG. 10. The shutter element 80' has an opening 80*a* formed therein, and this opening 80*a* is registered with the corresponding outlet port 78 when the shutter element 80' is at the open position.

Figure 15:
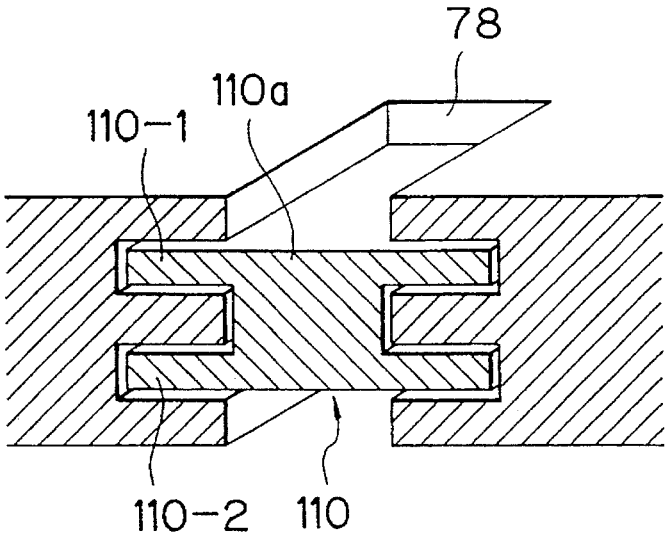
FIG. 15 is a perspective view showing a shutter body which may be used in place of a shutter element of the embodiment as shown in FIGS. 8 to 10.

FIG. 15 shows a slidable shutter body 110 which may be used in place of the slidable shutter element 80 as shown in FIGS. 8 to 10. The shutter body 110 includes two shutter elements 110-1 and 110-2 integrally connected to each other through a block element 110*a* extended therebetween. Namely, the shutter body 110 has a H-shaped cross-section, as apparent from FIG. 15. The slidable shutter body is incorporated into the outlet port 78 such that opposite side edges of each shutter element 110-1, 110-2 are slidably received in two side grooves which are formed in opposite side wall faces partially defining the outlet port 78, respectively, so as to form a labyrinth seal therebetween, whereby it is possible to effectively prevent a leakage of the developer through clearances formed between the shutter elements 110-1 and 110-2 and the side grooves can be effectively prevented. Note, when the shutter element 80 is used, a leakage of the developer through clearances formed between the shutter element 80 and the side grooves may occur.

Figure 16:
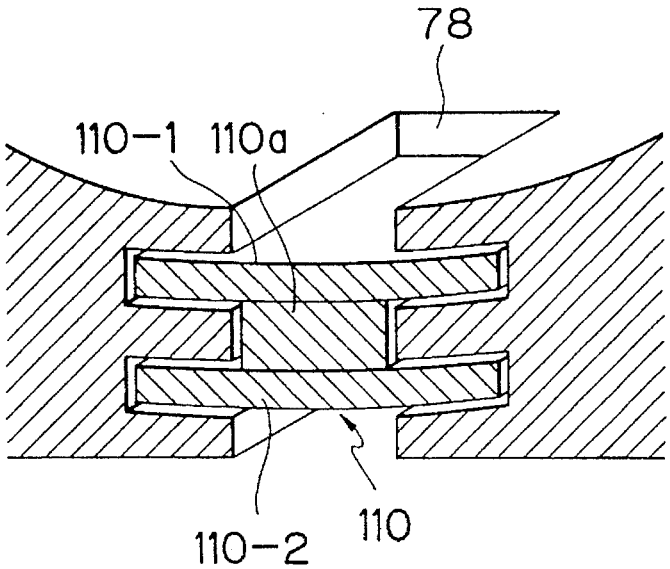
FIG. 16 is a perspective view showing a modification of the embodiment of FIG. 15.

FIG. 16 shows a modification of the shutter body 110 as shown in FIG. 15. This modified embodiment is identical to that of FIG. 15 except that the outlet port 78 is formed at a curved bottom surface zone of the vessel 46, and that the shutter elements 110-1 and 110-2 of the shutter body 110 are curved in accordance with the curved bottom surface zone of the vessel 46.

Figure 17:
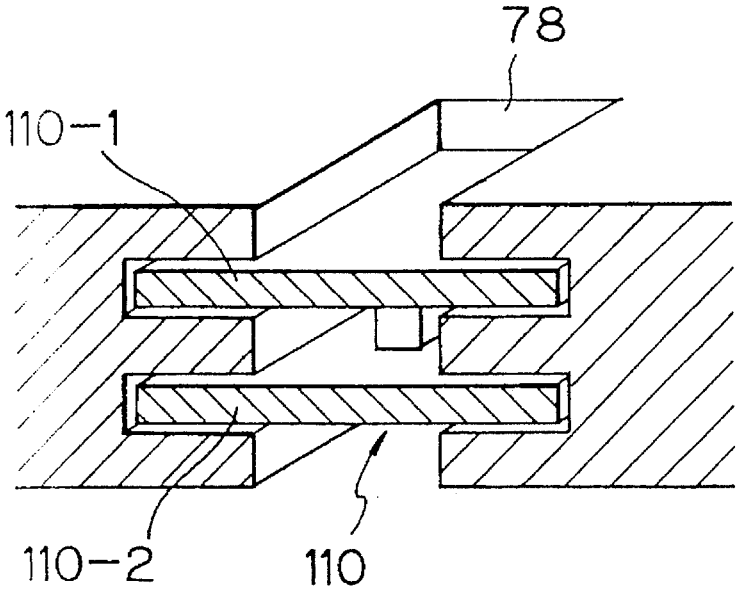
FIG. 17 is a perspective view showing another modification of the embodiment of FIG. 15.
Figure 18:
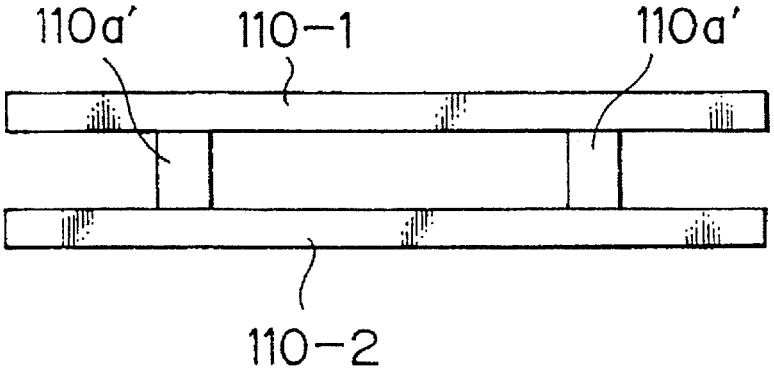
FIG. 18 is a side view of the shutter body shown in FIG. 17.

FIGS. 17 and 18 show another modification of the shutter body 110. This modified embodiment is identical to that of FIG. 15 except that the shutter elements 110-1 and 110-2 of the shutter body 110 are spaced from and integrally connected to each other through a pair of spacer elements 110*a'*, 110*a'* extended therebetween.

Note, in the embodiments shown in FIGS. 15 to 17, the shutter body 110 may include more than two shutter elements.

Finally, it will be understood by those skilled in the art that the foregoing description is of preferred embodiments of the present invention, and that various changes and modifications can be made without departing from the spirit and scope thereof.

We claim:

1. A developing device using a two-component developer, comprising:

vessel means for holding the two-component developer, said vessel means including two opposing side walls, each of which has a first opening and a second opening formed therein, said first and second openings arranged to establish a predetermined positional relationship therebetween;

magnetic roller means, rotatably provided within said vessel means and supported by inserting end portions of said magnetic roller means into the first openings in the two side walls of said vessel means, respectively, for entraining and bringing the two-component developer to a developing zone for a development of an electrostatic latent image;

doctor blade means, provided within said vessel means, for uniformly regulating an amount of the two-component developer entrained by said magnetic roller means, said doctor blade means having two end portions movably inserted into the second openings in the two side walls of said vessel means, respectively; and resilient means for resiliently abutting each of the end portions of said doctor blade means against an end edge of each of the second openings formed in the corresponding side wall of said vessel means, to position said doctor blade means at a predetermined and fixed clearance amount from said magnetic roller means based on said predetermined positional relationship, for a uniform regulation of an amount of the developer entrained by said magnetic roller means.

2. A developing device as set forth in claim 1, wherein the respective end edges of said second openings are upper end edges thereof.

3. A developing device as set forth in claim 2, wherein said resilient means includes at least one leaf spring disposed between a lower side of said doctor blade means and a bottom of said vessel means.

4. A developing device as set forth in claim 1, wherein the respective end edges of said second openings are lower end edges thereof.

5. A developing device as set forth in claim 4, wherein said resilient means includes two leaf springs disposed in said second openings between upper sides of the end portions of said doctor blade means and upper end edges of said second openings, respectively.

6. A developing device using a two-component developer including a toner component and a magnetic component, comprising:

vessel means for holding the two-component developer;

magnetic roller means, rotatably provided within said vessel means, for entraining and bringing the two-component developer to a developing zone for a development of an electrostatic latent image; and agitator means, provided in said vessel means, for agitating and circulating the two-component developer to cause a triboelectrification between the toner component and the magnetic component and a uniform distribution of the toner component in the magnetic component, said agitator means including at least two screw members arranged in parallel with each other to define passages for circulating the two-component developer, and a partition member, having two end portions, provided between said two screw members and extended therealong, said partition member having a length shorter than that of said two screw members, so that said circulating passages are in communication with each other at the two end portions of said partition member, said vessel means having an outlet port formed in a bottom thereof for discharging the two-component developer from said vessel means, said outlet port being positioned at an end zone of said circulating passages through which the two-component developer propelled by one of the screw members is introduced to the other screw member.

7. A developing device as set forth in claim 6, further comprising a slidable shutter means, incorporated into the bottom of said vessel means, for moving between a first position at which said slidable shutter means closes said outlet port and a second position at which said slidable shutter means opens said outlet port.

8. A developing device as set forth in claim 7, wherein said slidable shutter means includes a single shutter element, and opposite side edges of said shutter element are slidably received in two side grooves which are formed in opposite side wall faces partially defining the outlet port of said vessel means, respectively.

9. A developing device as set forth in claim 7, wherein said slidable shutter means includes at least two shutter elements spaced from each other and securely connected to each other, and opposite side edges of each said shutter element are slidably received in two side grooves which are formed in opposite side wall faces partially defining the outlet port of said vessel means, respectively, so as to form a labyrinth seal therebetween.

10. A developing device using a two-component developer including a toner component and a magnetic component, comprising:

vessel means for holding the two-component developer;

magnetic roller means, rotatably provided within said vessel means, for entraining and bringing the two-component developer to a developing zone for a development of an electrostatic latent image;

agitator means, provided in said vessel means, for agitating and circulating the two-component developer to cause a triboelectrification between the toner component and the magnetic component and a uniform distribution of the toner component in the magnetic component, said agitator means including at least two screw members arranged in parallel with each other to define a developer circulating passage;

an outlet port, formed in a bottom of said vessel means, for discharging the two-component developer from said vessel means, the outlet port of said vessel means being positioned at a location along said developer circulating passage; and slidable shutter means, incorporated into the bottom of said vessel means, for moving between a first position at which said slidable shutter means closes said outlet port and a second position at which said slidable shutter means opens said outlet port, said slidable shutter means including at least two shutter elements spaced from each other and securely connected to and integrated with each other, and opposite side edges of each said shutter element being slidably received in two side grooves which are formed in opposite side wall faces partially defining the outlet port of said vessel means, respectively, so as to form a labyrinth seal therebetween.

11. A developing device using a two-component developer, comprising:

a vessel to hold the two-component developer, said vessel including two opposing side walls, each of which has a first opening and a second opening formed therein, said first and second openings arranged to establish a predetermined positional relationship therebetween;

a magnetic roller rotatably provided within said vessel and supported by inserting end portions of said magnetic roller means into the first openings in the two side walls of said vessel, respectively, to entrain and bring the two-component developer to a developing zone for a development of an electrostatic latent image;

a doctor blade provided within said vessel, to uniformly regulate an amount of the two-component developer entrained by said magnetic roller, said doctor blade having two end portions movably inserted into the second openings in the two side walls of said vessel, respectively; and a resilient member to resiliently abut each of the end portions of said doctor blade against an end edge of each of the second openings formed in the corresponding side wall of said vessel, to position said doctor blade at a predetermined and fixed clearance amount from said magnetic roller based on said predetermined positional relationship, for a uniform regulation of an amount of the two-component developer entrained by said magnetic roller.

12. A developing device as set forth in claim 11, wherein the respective end edges of said second openings are upper end edges thereof.

13. A developing device as set forth in claim 12, wherein said resilient member includes at least one leaf spring disposed between a lower side of said doctor blade and a bottom of said vessel.

14. A developing device as set forth in claim 11, wherein the respective end edges of said second openings are lower end edges thereof.

15. A developing device as set forth in claim 14, wherein said resilient member includes two leaf springs disposed in said second openings between upper sides of the end portions of said doctor blade and upper end edges of said second openings, respectively.

16. A developing device using a two-component developer including a toner component and a magnetic component, comprising:

a vessel to hold the two-component developer;

a magnetic roller rotatably provided within said vessel, to entrain and bring the two-component developer to a developing zone for a development of an electrostatic latent image; and an agitator provided in said vessel, to agitate and circulate the two-component developer to cause a triboelectrification between the toner component and the magnetic component and a uniform distribution of the toner component in the magnetic component, said agitator including at least two screw members arranged in parallel with each other to define developer circulating passages, and a partition member, having two end portions, provided between said two screw members and extended therealong, said partition member having a length shorter than that of said two screw members, so that said developer circulating passages are in communication with each other at the two end portions of said partition member, said vessel having an outlet port formed in a bottom thereof to discharge the two-component developer from said vessel, said outlet port being positioned at an end zone of said developer circulating passages through which the two-component developer propelled by one of the screw members is introduced to the other screw member.

17. A developing device as set forth in claim 16, further comprising a slidable shutter incorporated into the bottom of said vessel, to move between a first position at which said slidable shutter closes said outlet port and a second position at which said slidable shutter opens said outlet port.

18. A developing device as set forth in claim 17, wherein said slidable shutter includes a single shutter element, and opposite side edges of said shutter element are slidably received in two side grooves which are formed in opposite side wall faces partially defining the outlet port of said vessel, respectively.

19. A developing device as set forth in claim 17, wherein said slidable shutter includes at least two shutter elements spaced from each other and securely connected to each other, and opposite side edges of each said shutter element are slidably received in two side grooves which are formed in opposite side wall faces partially defining the outlet port of said vessel, respectively, so as to form a labyrinth seal therebetween.

20. A developing device using a two-component developer including a toner component and a magnetic component, comprising:

a vessel to hold the two-component developer;

a magnetic roller rotatably provided within said vessel, to entrain and bring the two-component developer to a developing zone for a development of an electrostatic latent image;

an agitator provided in said vessel, to agitate and circulate the two-component developer to cause a triboelectrification between the toner component and the magnetic component and a uniform distribution of the toner component in the magnetic component, said agitator including at least two screw members arranged in parallel with each other to define a developer circulating passage;

an outlet port formed in a bottom of said vessel, to discharge the two-component developer from said vessel, the outlet port of said vessel being positioned at a location along said developer circulating passage; and a slidable shutter incorporated into the bottom of said vessel, to move between a first position at which said slidable shutter closes said outlet port and a second position at which said slidable shutter opens said outlet port, said slidable shutter including at least two shutter elements spaced from each other and securely connected to and integrated with each other, and opposite side edges of each said shutter element being slidably received in two side grooves which are formed in opposite side wall faces partially defining the outlet port of said vessel, respectively, so as to form a labyrinth seal therebetween.

* * * * *